US009269238B2

(12) United States Patent
Means

(10) Patent No.: US 9,269,238 B2
(45) Date of Patent: Feb. 23, 2016

(54) DOOR KNOCKER WITH AUDIO PLAYBACK

(71) Applicant: Beverly Means, Atlanta, GA (US)

(72) Inventor: Beverly Means, Atlanta, GA (US)

( * ) Notice: Subject to any disclaimer, the term of this patent is extended or adjusted under 35 U.S.C. 154(b) by 0 days.

(21) Appl. No.: 14/479,294

(22) Filed: Sep. 6, 2014

(65) Prior Publication Data

US 2015/0070143 A1 Mar. 12, 2015

Related U.S. Application Data

(60) Provisional application No. 61/876,917, filed on Sep. 12, 2013.

(51) Int. Cl.

| | |
|---|---|
| ***G08B 3/10*** | (2006.01) |
| ***G08B 13/08*** | (2006.01) |
| ***E06B 7/28*** | (2006.01) |
| ***G10K 3/00*** | (2006.01) |

(52) U.S. Cl.
CPC ... *G08B 3/10* (2013.01); *E06B 7/28* (2013.01); *G10K 3/00* (2013.01)

(58) Field of Classification Search
CPC ..... G08B 3/1008; G08B 1/08; G08B 3/10; G08B 3/00; G10K 15/04; G10K 13/00
USPC ..... 340/384.73, 691.1, 384.1, 692, 545.1, 340/328, 571, 545.3; 116/148
See application file for complete search history.

(56) References Cited

U.S. PATENT DOCUMENTS

| | | | | |
|---|---|---|---|---|
| 2,405,916 | A | 8/1946 | Neuhaus | |
| 2,747,538 | A | 5/1956 | Morse | |
| 3,938,120 | A | 2/1976 | O'Connell | |
| 4,100,581 | A | 7/1978 | Slack | |
| 5,900,802 | A * | 5/1999 | Segan | G08B 3/10 340/328 |
| 5,973,591 | A * | 10/1999 | Schwartz | G08B 3/10 340/384.1 |
| 6,285,294 | B1 * | 9/2001 | Avinger | G10K 15/04 340/326 |
| 6,324,261 | B1 | 11/2001 | Merte | |
| 6,721,408 | B1 * | 4/2004 | Bain | H04M 1/0291 379/157 |
| 6,758,678 | B2 | 7/2004 | Van Guilder | |
| 7,861,664 | B2 | 1/2011 | Wichard | |
| 9,013,575 | B2 * | 4/2015 | Scalisi | H04N 7/188 348/143 |
| 9,049,352 | B2 * | 6/2015 | Scalisi | H04N 7/188 |
| 9,055,202 | B1 * | 6/2015 | Scalisi | H04N 7/188 |
| 2003/0058071 | A1 * | 3/2003 | Yang | G01C 19/5719 335/205 |
| 2009/0038533 | A1 * | 2/2009 | Wichard | G10K 3/00 116/148 |
| 2010/0128588 | A1 | 5/2010 | Shuman | |
| 2010/0279752 | A1 | 11/2010 | Kim | |
| 2015/0054949 | A1 * | 2/2015 | Scalisi | H04N 7/188 348/143 |
| 2015/0092055 | A1 * | 4/2015 | Scalisi | H04N 7/188 348/143 |

* cited by examiner

*Primary Examiner* — Hoi Lau
(74) *Attorney, Agent, or Firm* — K. Karel Lambert; Lambert Patent Services LLC

(57) ABSTRACT

A novelty door knocker having an electronic sound effect or effects, the door knocker with mechanical arm, plate, switch or proximity sensor enabled to trigger a sound effect, and a battery-powered circuit for controlling and coordinating the acoustics with the trigger. The door knocker may be decorated with or shaped as a cartoon figure for use on a child's bedroom door, for example.

7 Claims, 11 Drawing Sheets

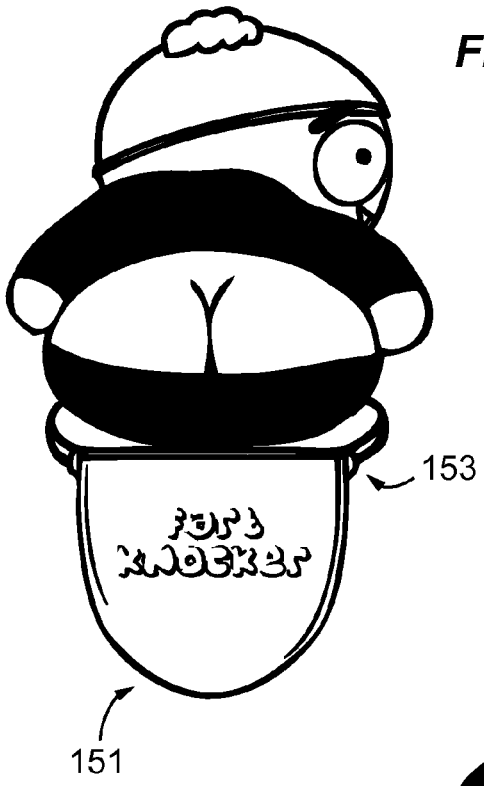
Fig. 7A
150
Fig. 7B
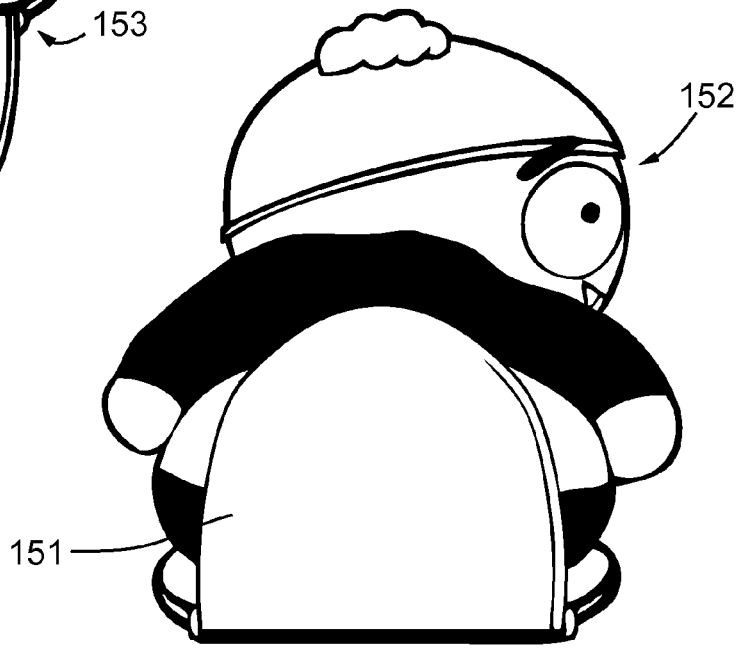

DOOR KNOCKER WITH AUDIO PLAYBACK

CROSS REFERENCE TO RELATED APPLICATIONS

This application is related to and claims priority to U.S. Provisional Patent No. 61/876,917 filed Sep. 12, 2014, which is herein incorporated in full by reference for all purposes.

FIELD OF THE INVENTION

This invention is related to a door knocker for use on a door, the door knocker having a novelty effect for producing a sound effect when actuated by the action of a person knocking.

BACKGROUND

Announcing yourself by knocking on a door can be a dull and uncomfortable experience. There is a need for novelty door knockers that translate this routine action into a surprising and entertaining experience for the visitor and the resident, particularly within a household, family, or group, where the door knocker is mounted on an internal door such a bathroom, bedroom, dorm room, home office, man cave, closet, and so forth.

SUMMARY

The novelty door knockers of the invention can turn a routine experience of knocking on a door into a surprising and fun experience for all ages. The door knocker is supplied with one or more sound effects to surprise or shock the visitor, or may be provided with a capacity to record and play back messages or other audio content.

In a preferred embodiment, the door knocker apparatus includes (a) a body member or housing enabled to be mounted on a door, the body member having a circuit board enclosed therein, the circuit board with processor, battery, clock, speaker driver, volatile and non-volatile memory, and program instructions, wherein the body member is attachable to a generally planar outside surface of a door; (b) an acoustic speaker having a resonant attachment to the body member and having an electronic connection to the speaker driver; (c) a swingplate or swingarm having a first aspect with hinged mechanical connection to the body member and a second aspect having a permanent magnet disposed so as to electromagnetically actuate the processor by a repetitive knocking action wherein the swingplate or swingarm is alternately moved from a contacting to a non-contacting position relative to a Hall Effect sensor mounted on the body member, the Hall Effect sensor having an electronic connection to the processor; and, further wherein the processor is programmed to modulate the speaker driver so as to play a sound effect on the acoustic speaker when activated by the knocking action. In general, the processor is configured to play a sound effect in response to more than one sequential knocking action of the swingplate or swingarm. Alternately, other electronic actuators may be used. Sound effects may be stored in non-volatile memory, and are waveforms operatively transmittable to the speaker driver or may be waveforms recorded by a user. In one preferred embodiment, the door knocker is configured to play an electronic digital signature acoustically recognizable as a fart, or one or more fart tones in a tune, for example. The body member may have the outline of a cartoon character, and be molded and colored accordingly and the swingarm or swingplate may be molded and colored in the shape of a door knocker, a clothing article, a toilet paper roll, or a toilet seat, for example. Decorative figures may also be supplied, and the body member may include an exchangeable coverplate for changing its decor. The body member or an underframe or chassis will generally include needed hardware, fasteners or peelable adhesive for example, to complete installation onto a door panel. Once mounted, the user actuates the sound effect by effecting a knocking motion with the door knocker and is rewarded with a sudden sound effect. In some instances, the user may enter a coded knock that actuates or inactuates the sound depending on the desired effect of the code. The novelty door knocker of the invention finds use in interior doors such as but not limited to, bedrooms, bathrooms, dorm rooms, home offices, man caves, attics, basements, cabinets, closets, and may also be used on exterior doors such as to guest houses, garage workshops, and covered porch entryways. Thus the invention finds use by teens, children and adults and can be used to communicate the identity of the visitor, or as a surprise to those who don't know the code.

The foregoing and other elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 4B simulates the action of the knocker.

FIGS. 7A and 7B are views of a fourth illustrated coverplate with hinged door knocker element showing an up position and a down position of the knocker element, shown here as a representation of a toilet seat.

Figure 1:
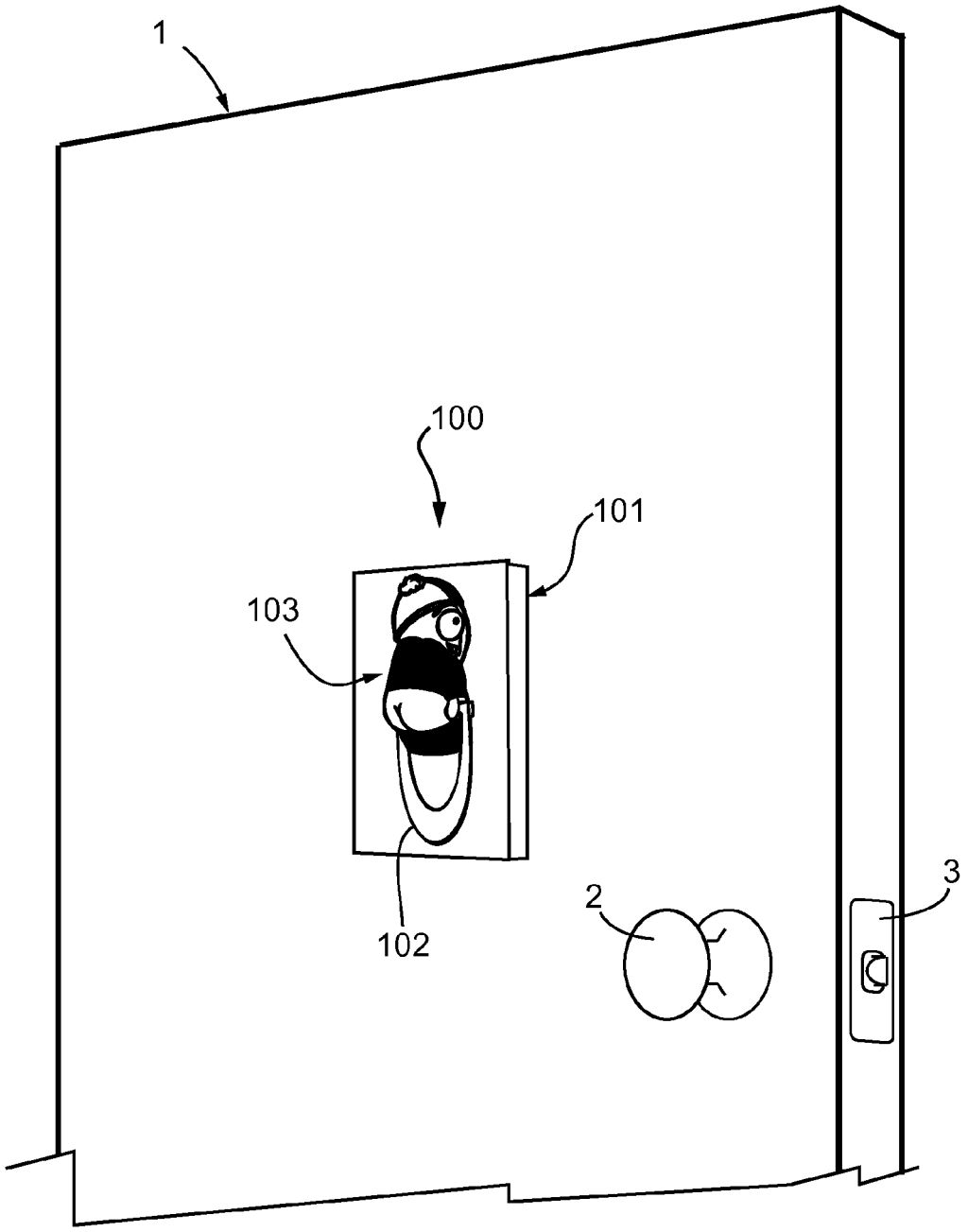
FIG. 1 is a view of a door knocker of the invention in use on a door.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

GLOSSARY

Certain terms throughout the following description are used to refer to particular features, steps or components, and are used as terms of description and not of limitation. As one skilled in the art will appreciate, different persons may refer to the same feature, step or component by different names. Components, steps or features that differ in name but not in function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

Door knocker: relates to a device having a mechanical, electrical or optical element for manually simulating a door knocker assembly, but as used here may also indicate an apparatus having an electronic device for using the knocking action to actuate of a sound effect for entertainment and amusement. Visual lighting effects may also be created.

General connection terms including, but not limited to "connected," "attached," and "affixed" are not meant to be limiting and structures so "associated" may have other ways of being associated. "Electrically connected" indicates a connection for conveying a current or a voltage therethrough.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional"—refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense that is as "including, but not limited to."

A "method" as disclosed herein refers one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Referring to FIG. 1, shown is a perspective view of a door knocker of the invention its context of use. Typically assembly 100 is mounted to a door panel 1 using conventional fasteners, adhesive, VELCRO(R), and so forth to attach body member 101 at the desired height. The device is battery operated so that no external wiring is required. In this view, a knocking member 102, termed here a swingplate or swingarm, is pivotably attached to the body member. The body member may receive a decorative finish, such as sculptural and colored features representing a cartoon character as shown here. Preferably, the body member has the outline shape of the decorative figure. However, other decorative figures and themes may be used without limitation. Also shown for context are door knob 2 and door latch mechanism 3.

Figure 2:
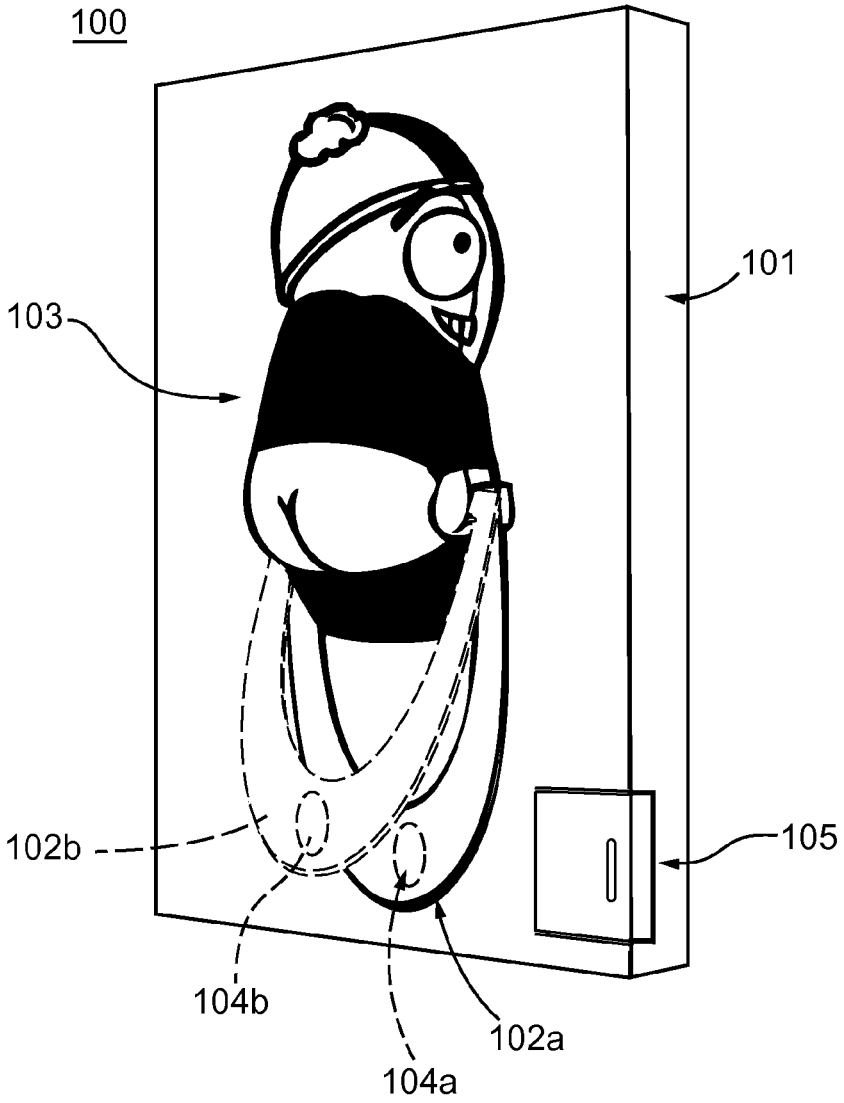
FIG. 2 is a close-up view showing structural features of a door knocker.

FIG. 2 is a close-up view showing structural features of a door knocker assembly 100. The body member 101 is generally provided with a decorative sculptural finish 103 (shown here as a cartoon action character), which provides pivot points for a hinged swingarm or swingplate, shown here in a relaxed position 102*a* and a pivoted position 102*b*. The hands of the cartoon character 103 serve as pivots for the U-shaped swingarm. In this embodiment, the swingarm includes a permanent magnet. The magnet has two positions (104*a*, 104*b*), a magnetically contacting position 104*a* and a magnetically non-contacting position 104*b*, and interacts with a Hall Effect sensor inside the body housing to actuate the sound mechanism, as will be described below. A battery cover 105 is formed on a front edge of the housing so that the battery may be easily replaced as needed.

While the body member or housing 101 is shown as a box shape, this is to illustrate the needed functions (to enclose a circuit board with speaker, and to attach to a door panel), and is not limited thereto. The decorative features applied to the body member may extend to the outline or peripheral edges of the decoration, such as a complex body outline of a cartoon character. Representation of the body member as a boxed rectangle is thus merely for clarity in illustration and is not limiting to the scope of the concept.

Figure 3B:
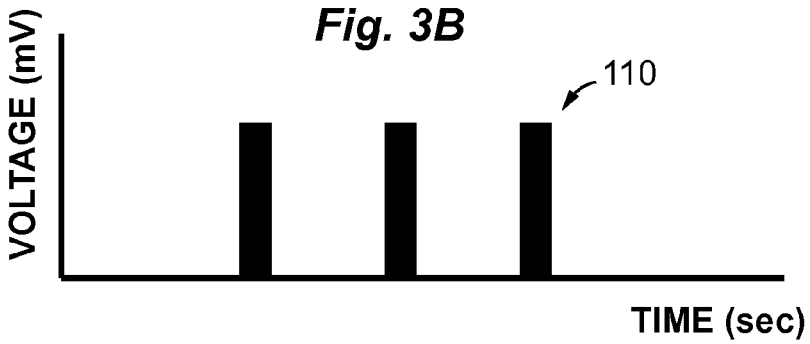
FIG. 3B shows current through a Hall Effect sensor in response to variation in a magnetic field produced by knocking.
Figure 3A:
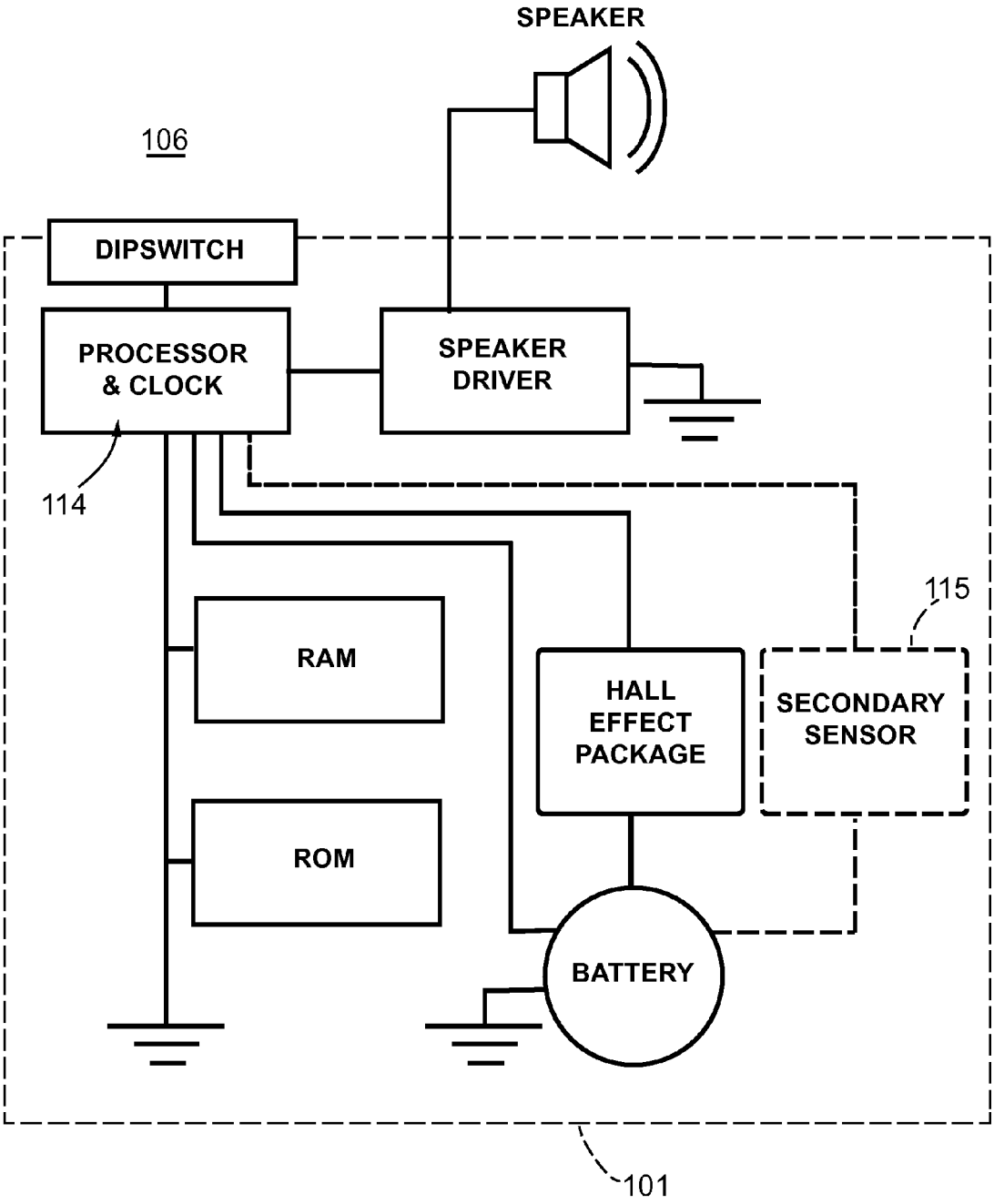
FIG. 3A is a schematic of a circuit for actuating a sound effect in response to a regular knock on the door.

FIG. 3A is a schematic of a first embodiment of a circuit for actuating a sound effect in response to a regular or coded knock on the door. Generally a circuit board 106 is mounted inside the body housing and includes programmable memory of a digital wave representation of a sound effect or sound effects that are used to drive a speaker. The speaker driver is under control of a processor 114, which executes a melody, tune or other sound effect from memory in response to a signal. Data buses are provided to convey digital signals between the components of the circuit. In this embodiment, the actuation signal is a repetitive digital output from a Hall Effect sensor. The Hall Effect package is configured to convert changes in the magnetic flux through a Hall Effect sensor into a digital output to the processor. In this instance, a voltage is produced when the magnetic field is broken, as when the swingarm 102 is lifted so that a permanent magnet 104 (FIG. 2) is lifted into a non-contacting position (FIG. 2, 102*b*). During the knock, the magnet is brought into proximity with the sensor (FIG. 2, 102*a*), causing a 5 mV digital signal output from a transistor in the Hall Effect package. Each instance of the digital signal is stored in RAM, and if two or more such signals occur in a time period and sequence as defined by a key code in memory, the processor will initiate an audio sequence. Otherwise the sequence will reset. Other variants may be configured if desired, for example the sound effect may play on the first knock, or may be triggered only when 3 knocks are completed. Users will quickly learn the sequence needed to actuate the sound effect, adding to the fun. Instructions may be included on the back of the unit, and may include a list of alternate pre-programmed sound effects next to the sequence of knocks needed to produce them: a Morse Code for audio actuation of different sound tracks.

Using a secondary sensor 115, activation may also be achieved by knocking on the door itself. Vibration or sounds of the knock may be detected by an accelerometer or by an audio pickup and conveyed to the processor. Signals received by the processor that match the sound or impact of an ordinary knock result in execution of a subroutine, for example a signal to the speaker to produce a different sound, such as a disapproving sound, for example "go away," or "Please use the door knocker", or "Please leave a message after the beep." One or more secondary sensors may be used, and may be programmed to act cooperatively with said Hall Effect package, termed here a "first actuator". Cooperative actions of a combination of sensors improve the capacity of the door knocker apparatus to discriminate between individuals at the door, and a combination of inputs from a plurality of sensors may be processed so as to produce individual sounds tailored to particular persons that override a default setting.

In one preferred embodiment, a default acoustic signal is the sound of a fart or a string of farts. In other embodiments, other sound effects may be included, optionally with a concealed switch to change the selection, to program, or to trigger a random selection from a sound library.

FIG. 3B shows a digital output from a Hall Effect sensor package in response to variation in a magnetic field produced by knocking three times. In mass produced items, all or some of the digital components of the circuit may be incorporated into a processor chip, the chip having integral clock, RAM, ROM, speaker driver and sensor, for example. Generally the speaker is mounted remotely in the body housing, and may be acoustically coupled to the door panel so as to resonate the sound through the door. The basic program for executing a sound effect in response to a knock may be stored in firmware or in ROM. A library of sound effects may be stored in ROM and selected for example with a dipswitch or at random. Thus the apparatus may be used to teach rudimentary hospitality to youngsters, and also provide more advanced lessons in cryptology when the child is ready. By providing a library of sounds and covers, the device may be modified to suit the child and the general age group, and thus may be a gift having long lasting value and serve to encourage return orders and replacement parts.

The actuation signal may be a preprogrammed code, such as known only to particular visitors, or may be a single knock, two knocks, or other knocking pattern, according to the desire of the user. Users knowing the code may use it to trigger the sound effect for their amusement, or the device may be programmed such that the code substitutes a preferred sound for a default sound effect or deactivates the sound. Programming may be accomplished with a simple dipswitch, for example, that sets the number of knocks or pattern of knocks needed to actuate or deactivate the sound effect. Other inexpensive electronic programming features having are known in the art and may be used if desired. While a dipswitch is cited as a means for selecting alternate outputs of a digital circuit, other means are known in the art, including software and firmware means, and have equivalent capabilities Similarly, other actuators may be incorporated in place of a Hall Effect sensor package. These include photodiodes, piezoelectric devices, thermal sensors representative of proximity detection devices, and mechanical switches such as are coupled to a reset pin on a processor-controlled circuit, acceleration switches such as are found in devices that turn on or off when struck, moved or shaken, and other motion detection switches as are known in the art. The act of knocking on the door on a wooden surface adjacent to the housing 101 (i.e., when not using the door knocker apparatus) may be detected by a vibrational or audio pickup conveyed to a processor in the apparatus, resulting in a disapproving sound, for example. Any of these sensors may be incorporated as shown generally in the circuit schematic of FIG. 3A (115).

Figure 4A:
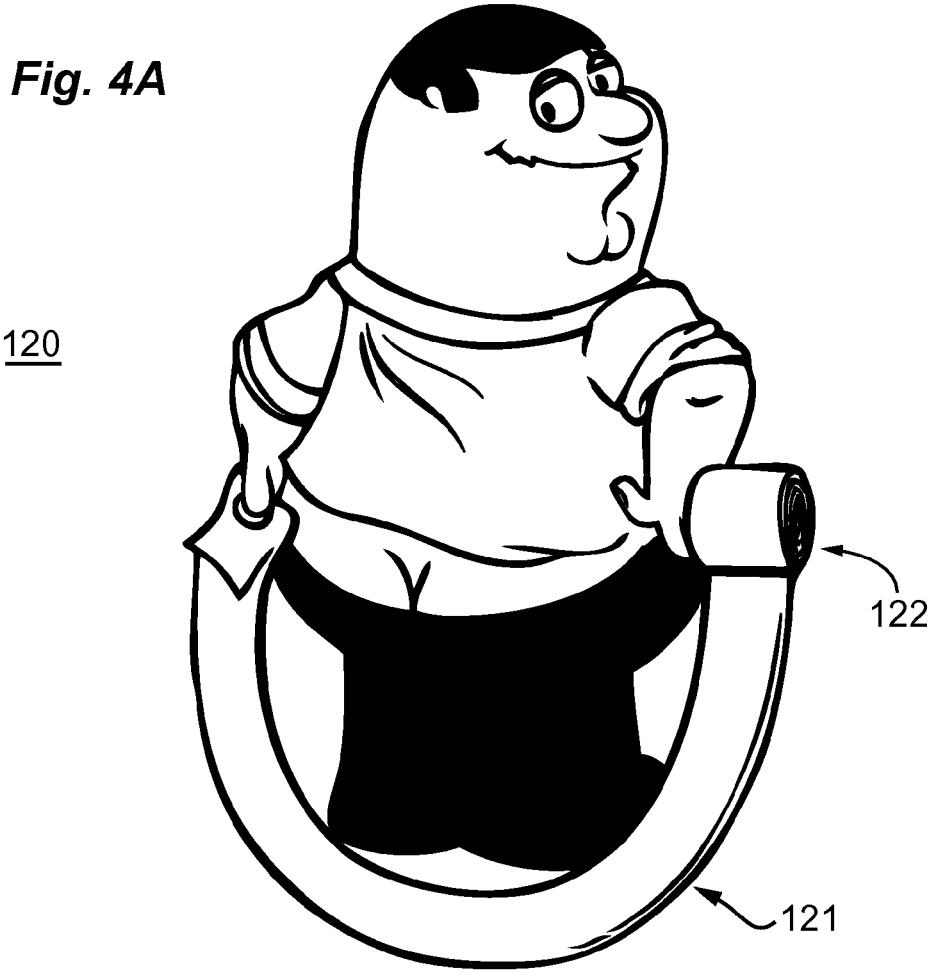
FIGS. 4A and 4B are views of an illustrated coverplate with hinged door knocker bar.
Figure 4B:
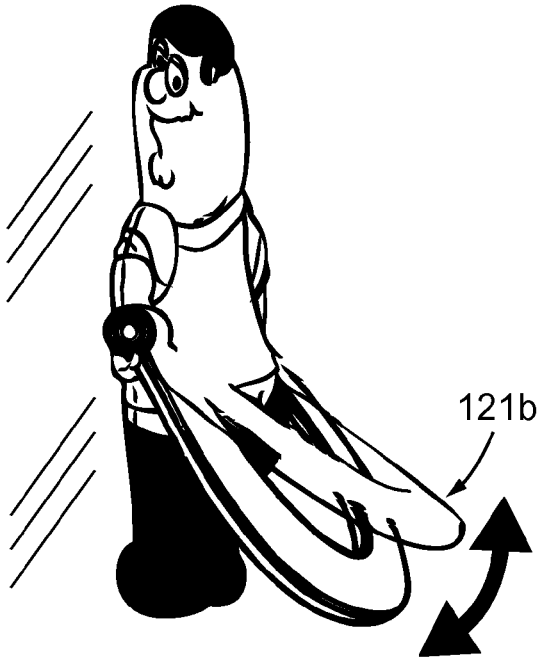

FIGS. 4A and 4B are views of an illustrated coverplate 120 with hinged door knocker bar actuator 121. FIG. 4B simulates the action of the knocker in moving up and down to actuate the sound effect or to effect a knock on the door. Here the swingarm is formed to resemble a loop from a roll of toilet paper 122. The double arrow indicates a knocking action of the apparatus as the knocker is moved up and down at position 121*b*.

The coverplate is generally formed as a molded aspect of the body member, but optionally may be affixed to the body during assembly, or may be interchangeable by the user and fitted to a universal mounting frame or chassis containing the circuit elements, processor, programmable instructions, memory, battery and speaker. The chassis may also provide a common ground for the electronics. The coverplate may be removable and interchangeable according to the decor desired by the user. Alternate memory chips may be provided with different sound libraries.

Figure 5A:
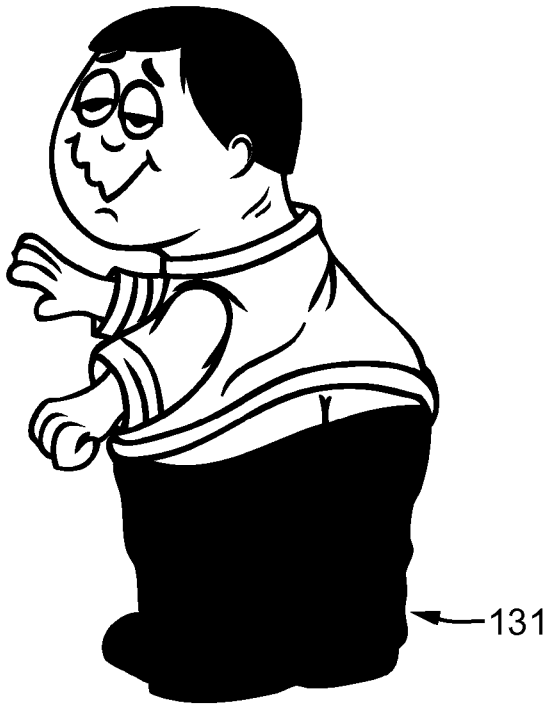
FIGS. 5A and 5B are views of a second illustrated coverplate with hinged door knocker element, here shown as a pant-like molded part.
Figure 5B:
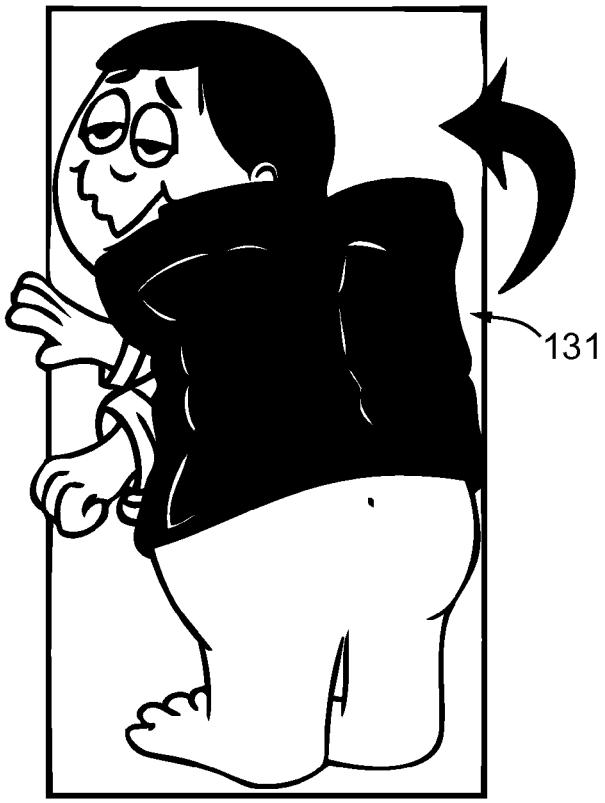
Figure 5C:
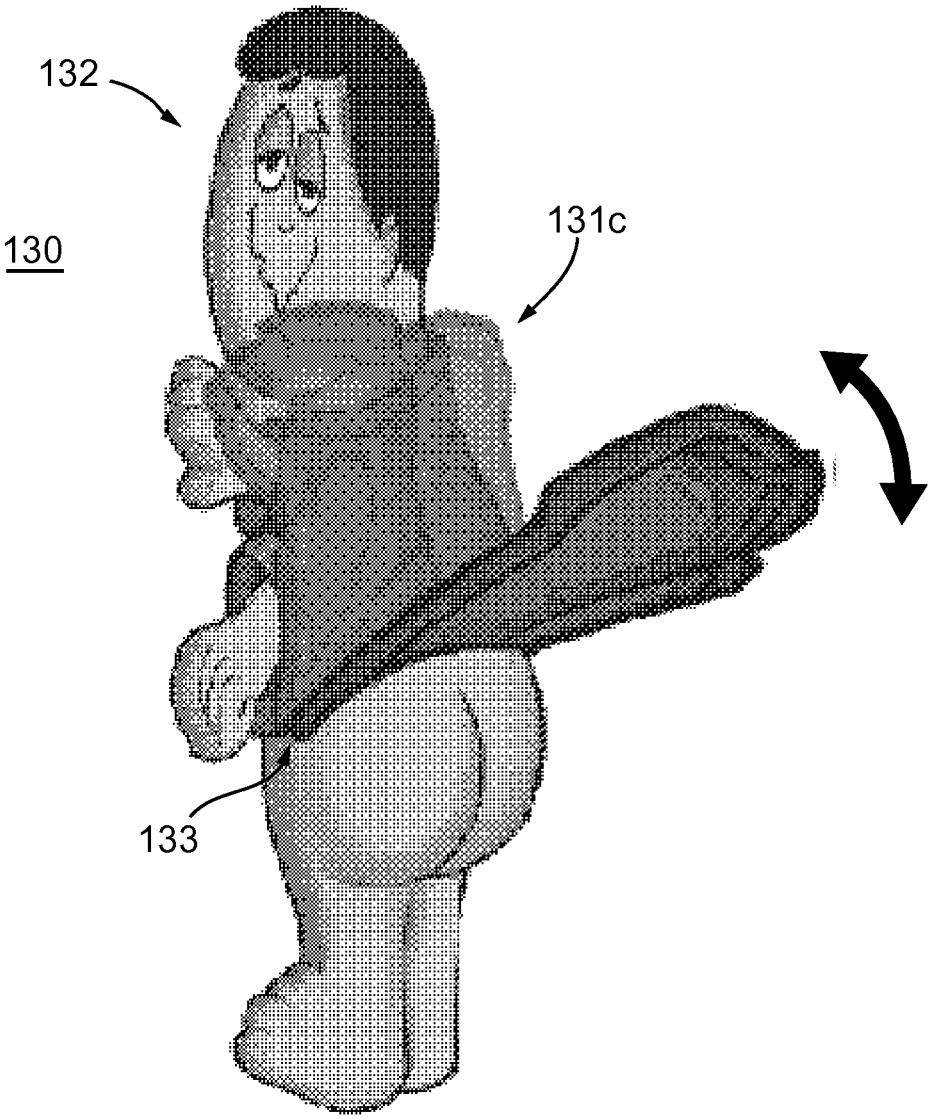
FIG. 5C is a color perspective view of the rendered figure of FIGS. 5A and 5B.

FIGS. 5A and 5B are views of a second illustrated coverplate 130 with hinged door knocker element 131, here shown as a pant-like molded part. FIG. 5C is a perspective view of the rendered figure of FIGS. 5A and 5B. The pants 131 swing up and down on a hinge 133 to effect a knocking sound or to actuate a sound effect (arrow, up position 131*c* against shoulders of character 132).

Figure 6A:
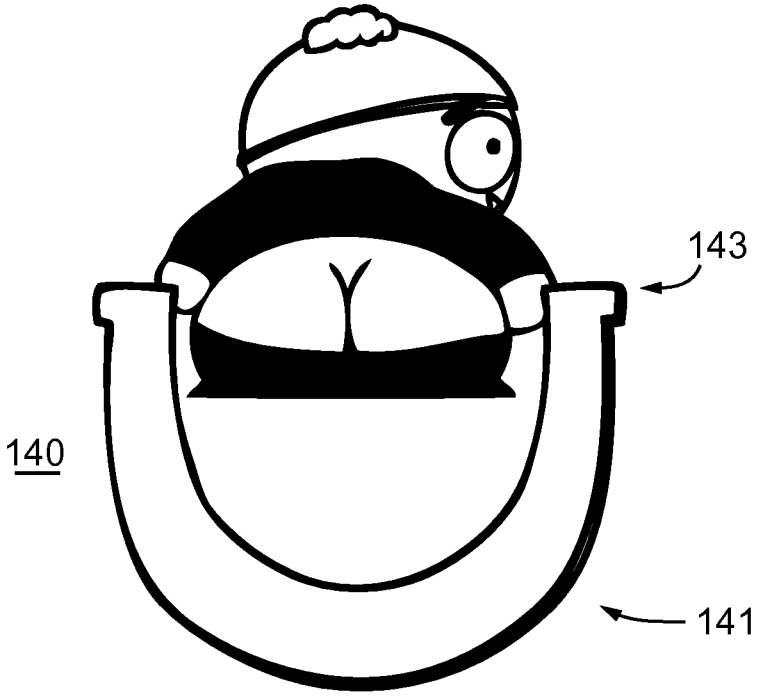
FIGS. 6A and 6B are views of a third illustrated coverplate with hinged door knocker bar showing an up position and a down position of the knocker element.
Figure 6B:
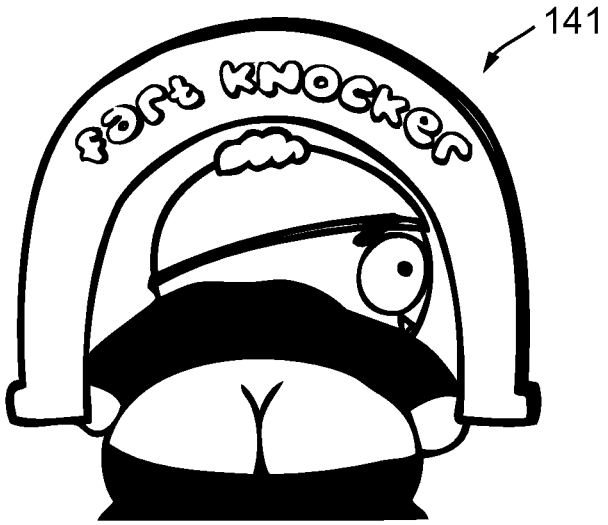

FIGS. 6A and 6B are views of a third illustrated coverplate 140 with hinged door knocker swingarm 141 showing an up position and a down position of the knocker element 141 with hinge 143.

FIGS. 7A and 7B are views of a fourth illustrated coverplate 150 with hinged door knocker element showing an up position and a down position of the knocker swingplate 151, shown here as a representation of a toilet seat 151 on a hinge 153. An actuator and supporting circuit elements are concealed under the coverplate, shown here as a decorative character 152. The sound produced is a stattaco series of low tones that taper off and is reproduced by sending a signal to a speaker according to a digital audio record played back from memory. The housing of the body may be adapted to serve as a resonant sound box, deepening and amplifying the sound.

Figure 7C:
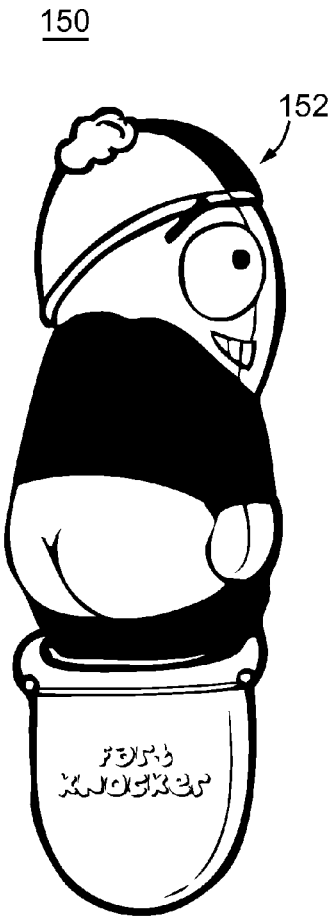
FIG. 7C is a perspective view of the door knocker figure of FIGS. 7A and 7B.
Figure 7D:
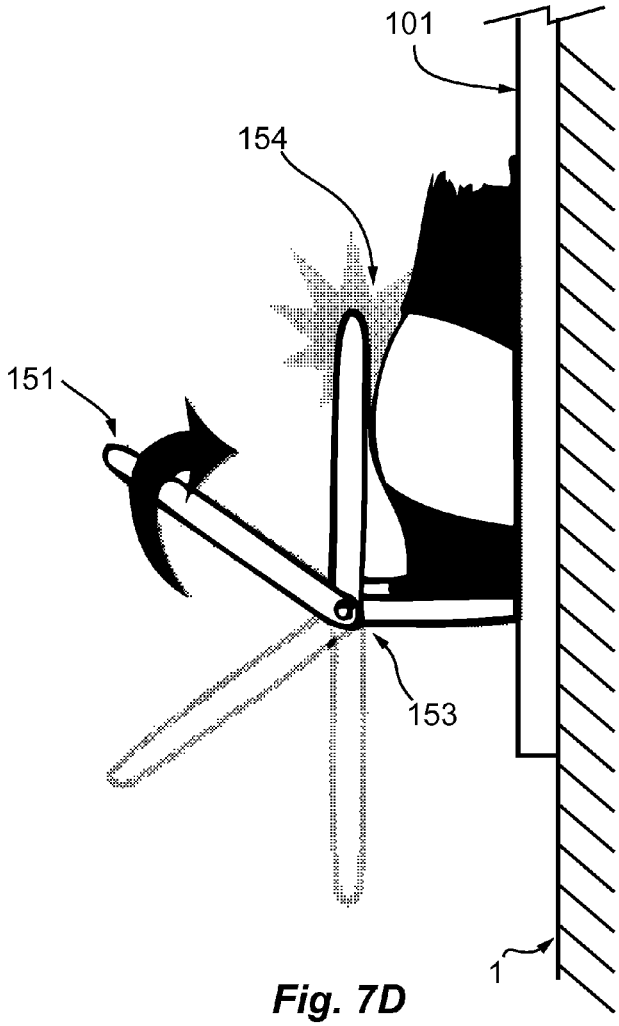
FIG. 7D illustrates the active motion of the knocker element in side view relative to the stationary door attachment members.

FIG. 7C is a perspective view of the door knocker figure of FIGS. 7A and 7B. FIG. 7D illustrates the active motion (arrow) of the knocker element in side view relative to the stationary body member 101 attached to a door 1. In this view the swingplate 151 pivots about 180 degrees up and down, and the Hall Effect sensor 154 may be mounted in the sculpted body character 152 so as to actuate the sound effect at the top of the swing instead of the bottom as shown in the earlier figures.

In general, a knocking member 151 is movably attached to the main body 101, which may be one of the construction components. For example, the knocking member is hinged at one end to allow the moving part to swing in a short arc away from the body member. When the knocking member is released, it will swing back via gravity (or may be spring loaded) to its resting position, and generate a loud sound to notify the resident of a visitor. In another example, contact of the knocking member with the base unit can also trigger the playback of a recorded electronic message via integrated circuitry. In yet another embodiment, the circuit may also include a microphone for recording a message when actuated by a knock so that the message may later be played back. A signal light may be incorporated to indicate that a message was left.

Figure 8A:
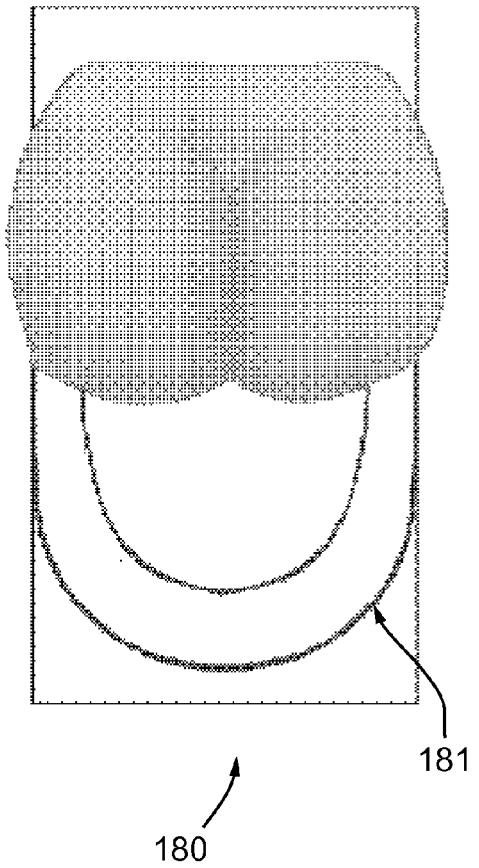
FIGS. 8A, 8B and 8C are views of another illustrated door knocker with audio and visual effects.
Figure 8B:
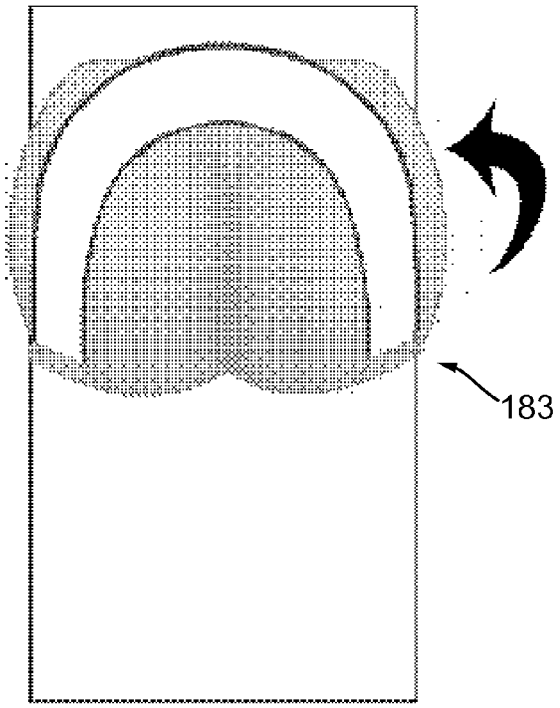
Figure 8C:
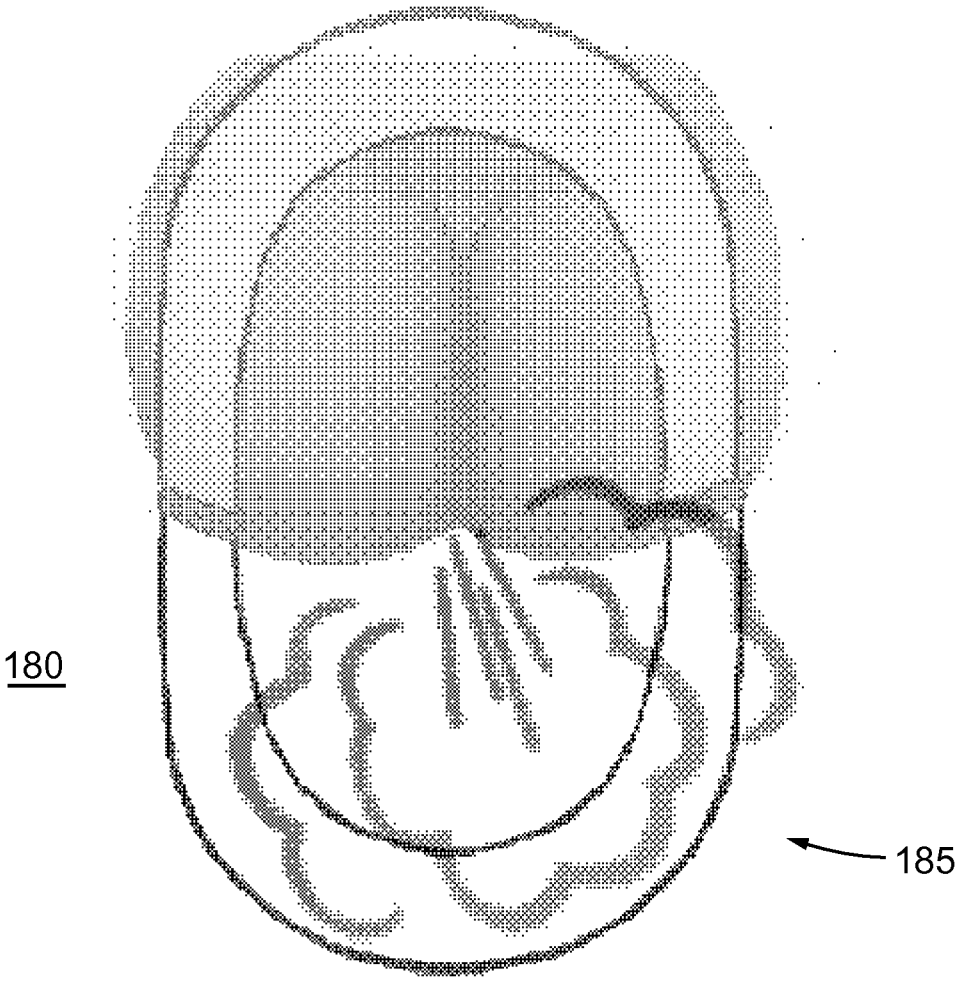

FIGS. 8A, 8B and 8C are views of another illustrated door knocker 180 with audio and visual effects. In this view the door knocker body includes a "U-shaped" swingarm trigger member 181 mounted on a hinge 183. The body is also created to include a visual display 185, here a colored puff such as may be shown on an LED screen enabled for color graphics (not shown), or by including fluorescent or luminescent pigments that are actuated by a UV light from inside the housing, for example. Optionally, a scent may be released from an insertable blister pack and spray device concealed in the body of the housing.

In yet another embodiment, the invention may be packaged as a kit for teaching electronics to a child at a young age. Varying levels of assembly difficulty may be matched to age ranges so that at the most simple level, the circuit board is pre-assembled, and at more challenging levels, soldering of individual components is needed. Pre-teenage children may be encouraged to complete this as a project and move on to more intensive studies of electronics or cryptology.

The above disclosure is sufficient to enable one of ordinary skill in the art to practice the invention, and provides the best mode of practicing the invention presently contemplated by the inventor. While above is a complete description of the preferred embodiments of the present invention, various alternatives, modifications and equivalents are possible. These embodiments, alternatives, modifications and equivalents may be combined to provide further embodiments of the present invention. Further, all foreign and/or domestic publications, patents, and patent applications cited herein, whether supra or infra, are hereby incorporated by reference in their entirety for all they teach. The inventions, examples, and embodiments described herein are not limited to particularly exemplified materials, methods, and/or structures. Various modifications, alternative constructions, changes and equivalents will readily occur to those skilled in the art and may be employed, as suitable, without departing from the true spirit and scope of the invention. Therefore, the above description and illustrations should not be construed as limiting the scope of the invention, which is defined by the appended claims.

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety.

SCOPE OF CLAIMS

While the above is a complete description of selected embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

I claim:

1. A door knocker apparatus, which comprises:

(a) a body member enabled to be mounted on a door, said body member having a circuit board enclosed therein, said circuit board with processor, battery, clock, speaker driver, volatile and non-volatile memory, wherein said body member is attachable to a generally planar outside surface of a door;

(b) an acoustic speaker having an attachment to said body member and having an electronic connection to said speaker driver;

(c) a swingplate or swingarm having a first aspect with hinged mechanical connection to said body member and a second aspect having a permanent magnet disposed so as to electromagnetically actuate said processor by a repetitive knocking action defined by a movement of said swingplate or swingarm from a magnetically contacted to a non-contacted position relative to a Hall Effect sensor mounted on said body member, said Hall Effect sensor having an electronic connection for delivering an electrical signal to said processor; and, further wherein said processor is programmed to actuate and modulate an output from said speaker driver so as to play a sound effect on said acoustic speaker when activated by said knocking action.

2. The door knocker apparatus of claim 1, wherein said processor is configured to play said sound effect in response to an encoded sequential knocking action of said swingplate or swingarm and a default sound effect when said encoded sequential knocking action is incorrectly entered.

3. The door knocker apparatus of claim 1, wherein said non-volatile memory comprises one or more waveforms operatively transmittable to said speaker driver for emitting one or more sound effects in response to a knocking action.

4. The door knocker apparatus of claim 1, wherein said body member is shaped and colored in the likeness of a cartoon character.

5. The door knocker apparatus of claim 4, wherein said swingarm or swingplate is molded and colored in the shape of a door knocker, a clothing article, a toilet paper roll, a toilet seat, a cartoon character, or a decorative figure.

6. The door knocker apparatus of claim 1, wherein said battery is replaceable through a reattachable panel closure in said body member.

7. The door knocker apparatus of claim 1, further comprising a visual effect.

* * * * *